US006257990B1

(12) United States Patent
Kariatsumari

(10) Patent No.: US 6,257,990 B1
(45) Date of Patent: Jul. 10, 2001

(54) GOLF BALL RETRIEVER

(76) Inventor: Ken Kariatsumari, 9295 Elk Dr., P.O. Box 433 Port Hardy B.C. (CA), V0N 2PO ( * ) Notice: Subject to any disclaimer, the term of this patent is extended or adjusted under 35 U.S.C. 154(b) by 0 days.

(21) Appl. No.: 09/388,612

(22) Filed: Sep. 2, 1999

(51) Int. Cl.[7] ..... A63B 47/02
(52) U.S. Cl. ..... 473/286; 294/19.2
(58) Field of Search ..... 473/286; 294/19.2

(56) References Cited

U.S. PATENT DOCUMENTS

| | | | |
|---|---|---|---|
| D. 205,526 | | 8/1966 | Lehman . |
| D. 216,138 | | 11/1969 | Carignan . |
| D. 347,871 | | 6/1994 | Upton . |
| 1,674,294 | | 6/1928 | O'Rourke . |
| 2,135,232 | | 11/1938 | Dawn . |
| 2,448,644 | | 9/1948 | Williams . |
| 2,482,294 | | 9/1949 | Sandor . |
| 2,524,527 | * | 10/1950 | Jasmer . |
| 2,561,815 | | 7/1951 | Oberg . |
| 3,046,044 | | 7/1962 | Christle . |
| 3,773,374 | | 11/1973 | D'Luhy . |
| 3,922,027 | * | 11/1975 | Nesselt . |
| 4,718,673 | * | 1/1988 | Bateham . |
| 4,728,134 | | 3/1988 | Allen . |
| 4,746,156 | * | 5/1988 | Kremer . |
| 4,844,526 | | 7/1989 | Young . |
| 4,968,079 | | 11/1990 | Burton . |
| 5,277,466 | | 1/1994 | Wall . |
| 5,303,967 | | 4/1994 | Dubow . |
| 5,326,145 | | 7/1994 | Lee . |
| 5,575,519 | | 11/1996 | Mansbridge . |

* cited by examiner

*Primary Examiner*—Mark S. Graham
*Assistant Examiner*—Stephen L. Blau
(74) *Attorney, Agent, or Firm*—Oyen Wiggs Green & Mutala

(57) ABSTRACT

A golf ball retriever comprising a pivotally-attached cradle for retrieving golf balls. The cradle is pivotally attached to a forked end. The cradle is comprised of two cradle arms and a catchment member, all of which are curved to receive and engage the curvature of a golf ball. At a point proximate to the cradle catchment member, the cradle arms are spaced apart a distance less than the diameter of a golf ball. The cradle arms diverge from this point until they become connected to the cradle catchment member, causing the retrieved golf ball to be continuously guided into the cradle, where it is securely engaged at three locations. The retriever may have a handle having a forked end. The handle may be attachable to an elongated rod or a golf club, for example by a tube attached to the handle, for reaching distant golf balls. The handle may also hinge together to compact the retriever for storage. In an alternative embodiment, the cradle arms are connected to a transverse bar, which is pivotally attached to a shaft.

17 Claims, 5 Drawing Sheets

GOLF BALL RETRIEVER

TECHNICAL FIELD

This invention relates to a device for recovering golf balls from ponds, creeks, rivers, ditches, weeds, mud or other inaccessible locations.

BACKGROUND

It is an inevitable aspect of golf that the occasional shot will land in a location where it is impossible to not only hit a recovery shot, but where it may be extremely difficult to even retrieve the ball. For example, it is very difficult to retrieve balls partially buried in mud, weeds or rocks at the bottom of a pond, river or other water hazards. Balls may also be located in casual water or some other wet or muddy location where it would be inconvenient or messy to walk through.

The traditional golf ball retriever is a cone or basket, usually constructed of coiled wire, aluminum, plastic or die-cast material, fixed to the end of a telescoping rod. Such a device is used to "scoop" the ball out of a water hazard. This is easily accomplished if the ball is visible in the water and is readily accessible. These traditional retrievers are, however, limited in certain respects. First, the cone or basket is somewhat bulky so that retrieving balls from intricate locations between rocks or in long grass can be very challenging and time-consuming. Second, the cone or basket of the traditional retriever is usually lightweight and flimsy. This structure is sufficient to retrieve balls simply sitting on a pond bottom, but is wholly inadequate to dig for balls partially or almost entirely buried in mud. This is particularly the case where the telescoping rod is fully extended, providing the user with little leverage to dig the ball out from a distance. Third, the traditional retriever requires that the cone or basket be maintained in an upright position after the ball is retrieved. Unfortunately, this is not always possible and a slight twisting of the basket will cause the retrieved ball to be dropped and the whole procedure will need to be repeated. Finally, due to the presence of an intervening object, such as a rock, lying immediately in front of a ball and between the user and the ball, it is not always possible to "scoop" a wayward golf ball ("scooping" refers to placing the retriever underneath the golf ball and lifting upwardly). Instead, the golf ball could only be retrieved if it was "raked" (meaning that the user places the retriever over the top of the ball and pulls it towards him or herself). Due to the fixed, open configuration of the cone or basket, it is not possible to retrieve balls by raking with the traditional retriever.

Several attempts have been made to address the deficiencies of the traditional golf ball retriever. One style of retriever consists of a rigid handle connected to a plurality of resilient or flexible wires bent in such a way as to form an opening between the wires which is slightly smaller than the diameter of a golf ball. The retriever is placed over the top of a golf ball and downward pressure is applied, causing the wires to yield slightly, allowing the golf ball to enter the opening. After the ball has entered, the wires return to their original positions, encircling the ball for retrieval. U.S. Pat. No. 2,448,644 (issued Sep. 7, 1948 to Williams), U.S. Pat. No. 2,482,294 (issued Sep. 20, 1948 to Sandor), U.S. Pat. No. 4,728,134 (issued Mar. 1, 1988 to Allen), U.S. Pat. No. 5,277,466 (issued Jan. 11, 1994 to Wall) and U.S. Pat. No. 5,326,145 (issued Jul. 5, 1994 to Lee) are retrievers of this style. While these retrievers firmly hold a retrieved ball, thus addressing the concern that traditional retrievers may drop balls upon a slight twisting from an upright position, they have deficiencies of their own. Due to the shape of these retrievers, it is not possible to dig a buried (partial or otherwise) ball out of mud or retrieve a ball found between rocks. Additionally, due to the necessity for the application of downward pressure to utilize these retrievers, scooping a golf ball is not possible.

U.S. Pat. No. 5,575,519, issued Nov. 19, 1996 to Mansbridge, embodies another attempt to address the deficiencies of the traditional golf ball retriever. Mansbridge illustrates in FIGS. 9, 14 and 18 and describes a holder consisting of a frame (which may be U-shaped) with wire-like containment element(s) rigidly attached thereto. The wire containment element defines a central catchment section, the diameter of which is such to allow a golf ball to sit therein for retrieval. This positioning, along with the presence of the frame, prevents the ball from being dropped upon slight twisting of the holder. However, more abrupt twisting would allow the ball to escape the central catchment section and mouth formed thereby. Additionally, it is not possible to retrieve a ball by raking with Mansbridge, should that be necessary.

U.S. Pat. No. 3,773,374, issued Nov. 20, 1973 to D'Luhy, on the other hand, describes a retriever which can be used for raking, but which is inadequate for scooping. D'Luhy describes a retriever consisting of a double-ended hook pivotally secured to a telescoping rod. The double-ended hooks are spaced apart a distance so that a golf ball is engaged when the hooks are raked from behind (relative to the user) the ball. As noted above, D'Luhy can only be used to rake a golf ball. This is insufficient for situations where a ball has come to rest immediately adjacent a rock or other obstacle, leaving no room for raking the hooks behind the ball.

Accordingly, it is the object of the present invention to overcome the deficiencies of the prior art and to provide a simple, reliable and effective golf ball retriever that is capable of both scooping and raking a golf ball out of a variety of locations.

SUMMARY OF INVENTION

One aspect of this invention provides a golf ball retriever having a forked end with two arms spaced apart at their free ends by a distance greater than the diameter of a golf ball, and a cradle. The cradle is pivotally attached to the free ends of the arms. The cradle has two cradle arms and a cradle catchment member therebetween. The cradle arms being spaced apart from one another at a point proximate to said cradle catchment member by a distance less than the diameter of a golf ball. The cradle arms are curved and have their concave side adjacent the cradle catchment member. The cradle catchment member being curved and cooperating with the cradle arms so that each of the cradle arms and the cradle catchment member engages a golf ball supported in the cradle.

In another aspect of the invention, the golf ball retriever comprises a handle having a forked end with two arms spaced apart at their free ends by a distance greater than the diameter of a golf ball and a cradle. The cradle is pivotally attached to the free ends of the handle arms. The cradle has two cradle arms and a cradle catchment member therebetween. The cradle arms are spaced apart from one another at a point proximate to the cradle catchment member by a distance less than the diameter of a golf ball and are curved. The concave side of the cradle arms is adjacent the cradle catchment member. The cradle catchment member is also curved and cooperates with the cradle arms so that each of the cradle arms and the cradle catchment member engages a golf ball supported in the cradle.

Each of the cradle arms has a first and a second end. The first ends are pivotally attached to the free ends of the handle and the second ends are connected to the cradle catchment member. The cradle arms may diverge from the point proximate to the cradle catchment member to the second ends of the cradle arms. Preferably, the cradle arms and the cradle catchment member comprise a single integral member, which may be a stainless steel wire. Preferably, the cradle arms and the handle arms are all longer than the diameter of a golf ball. Preferably, the cradle catchment member abuts the handle to prevent the cradle from fully pivoting.

The handle may be attachable to an elongated rod or golf club. This may be done by a tube attached to the handle. The handle may hinge to compact the retriever for storage.

In an alternative embodiment, the first ends of the cradle arms are connected to a first transverse bar which is longer than the diameter of a golf ball and which is pivotally attached to the shaft. The alternative embodiment may also have a second transverse bar, also longer than the diameter of a golf ball and which is substantially parallel to the first transverse bar. The second transverse bar is connected to the cradle arms at points distal to the shaft relative to the first transverse bar. The shaft also comprises at least one pivotally attached hook to prevent the cradle from pivoting until the golf ball is engaged by the cradle.

DESCRIPTION

The golf ball retriever of the present invention has a rounded cradle which guides and securely engages a golf ball for retrieval. The cradle is pivotally attached to a forked end of the retriever.

The golf ball retriever of the present invention utilizes a pivotally-attached, rounded cradle which guides and securely engages a golf ball for retrieval.

Figure 1:
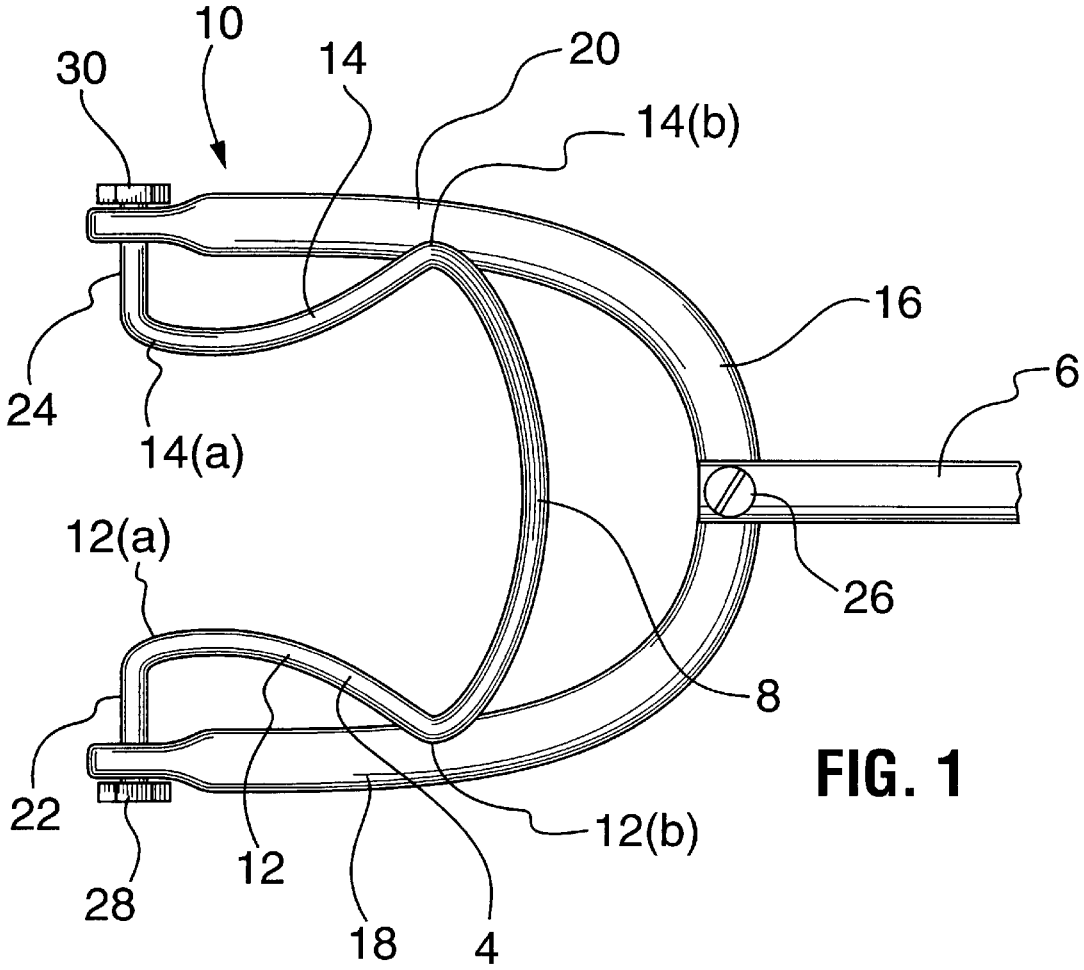
FIG. 1 is a plan view of the golf ball retriever of the present invention.
Figure 2:
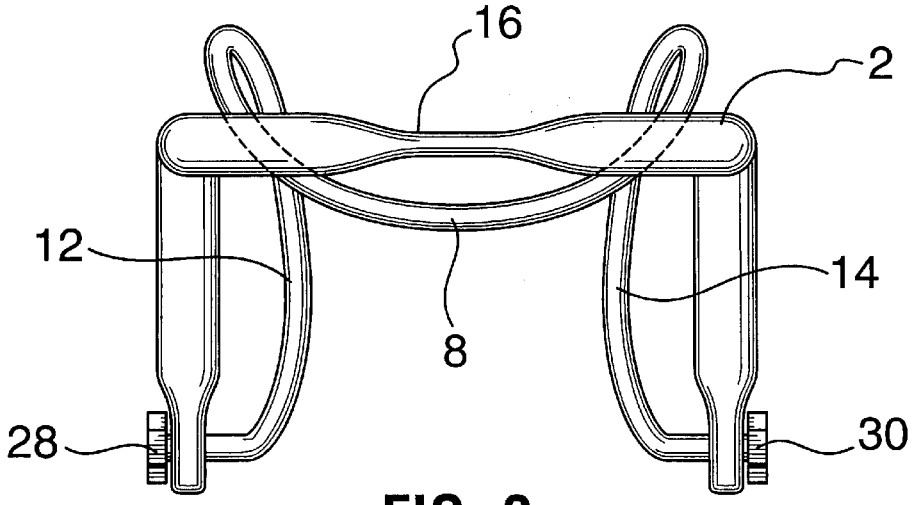
FIG. 2 is a rear partial view of the golf ball retriever of FIG. 1 absent the shaft.

In the embodiment illustrated in FIGS. 1 and 3–7(*c*), golf ball retriever 10 comprises U-shaped member 2, cradle 4 and shaft 6 (shaft 6 is not illustrated in FIG. 2). Retriever 10 has a handle by way of which cradle 4 can be positioned to retrieve a golf ball. In the embodiment illustrated in FIGS. 1, 3–7(*c*), U-shaped member 2 and shaft 6 constitute a handle having a forked end. As is explained further below, a golf ball retriever according to the invention may have a handle which can be used alone. In the alternative, the golf ball retriever may have a handle in which the part holding the cradle is attachable to an extension, such as an elongated rod or golf club.

Cradle 4 is comprised of cradle catch member 8 and cradle arms 12 and 14, which each have a first end 12(*a*) and 14(*a*), respectively, and a second end, 12(*b*) and 14(*b*), respectively. Second ends 12(*b*) and 14(*b*) are each connected to cradle catch member 8.

U-shaped member 2 has a base 16 and two arms 18 and 20. For best results, cradle arms 12 and 14 and arms 18, 20 of U-shaped member 2 should all be longer that the diameter of a golf ball. Shaft 6 is attached to base 16 of U-shaped member 2 by a traditional nut and bolt assembly 26. As illustrated in FIG. 2, base 16 of U-shaped member may be flattened to allowed eased attachment with shaft 6 and to enhance the structural strength of retriever 10. Arms 18 and 20 of U-shaped member 2 may be straight (see FIG. 4), but preferably are curved (as illustrated in FIGS. 1–3, 5–7(*c*)) for reasons which will become apparent. Arms 18 and 20 of U-shaped member are spaced apart a distance greater than the diameter of a golf ball. This allows arms 18 and 20 to form a mouth which the ball passes through before being captured by cradle 4.

Cradle 4 is pivotally attached to U-shaped member 2 at first ends 12(*a*) and 14(*a*) of cradle arms 12 and 14. Specifically, protrusions 22 and 24 extend laterally from first ends 12(*a*) and 14(*a*), respectively, through apertures (not shown) in the distal ends of arms 18, 20 of U-shaped member 2. Protrusions 22 and 24 are threaded to receive nuts 28 and 30. Numerous other means of pivotally attaching first ends 12(*a*) and 14(*a*) to arms 18, 20 could be employed.

Retriever 10 can be used to retrieve a golf ball by using either a raking motion or a scooping motion, depending upon the location of the golf ball. It is advantageous to scoop a ball where it is lying visibly at the bottom of a pond, river or other water hazard or where it is lying on the near side of a rock or other obstruction (i.e. the ball is between the user and the obstruction). Conversely, it is advantageous to rake a ball where it is lying on the far side of a rock or obstruction and it is not possible for the user to get in a position to scoop the ball.

Figure 6A:
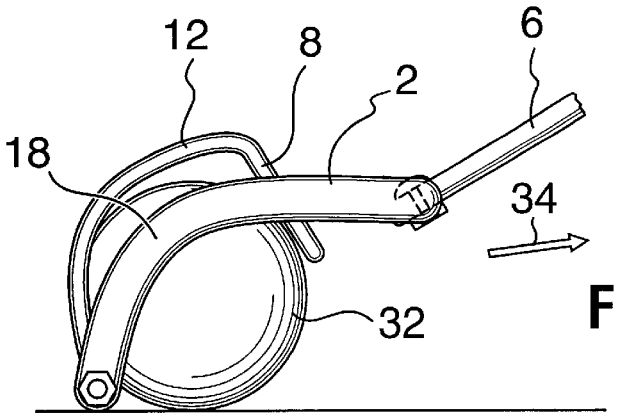
FIGS. 6(*a*), 6(*b*), and 6(*c*) illustrate the sequence of retrieving a golf ball with a raking motion using the golf ball retriever of FIG. 1.
Figure 6B:
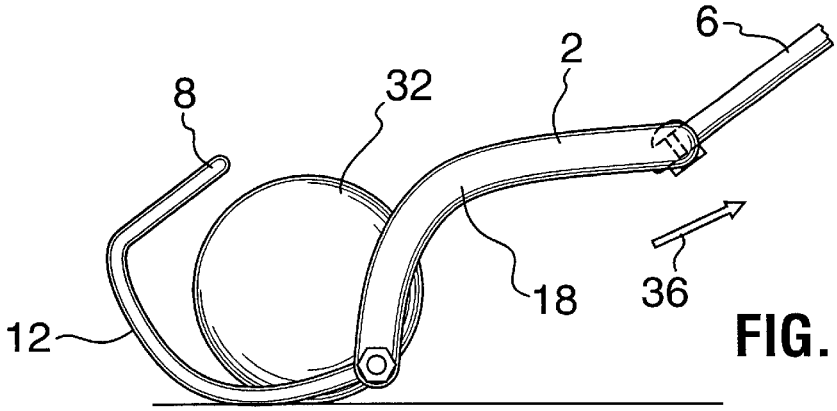
Figure 6C:
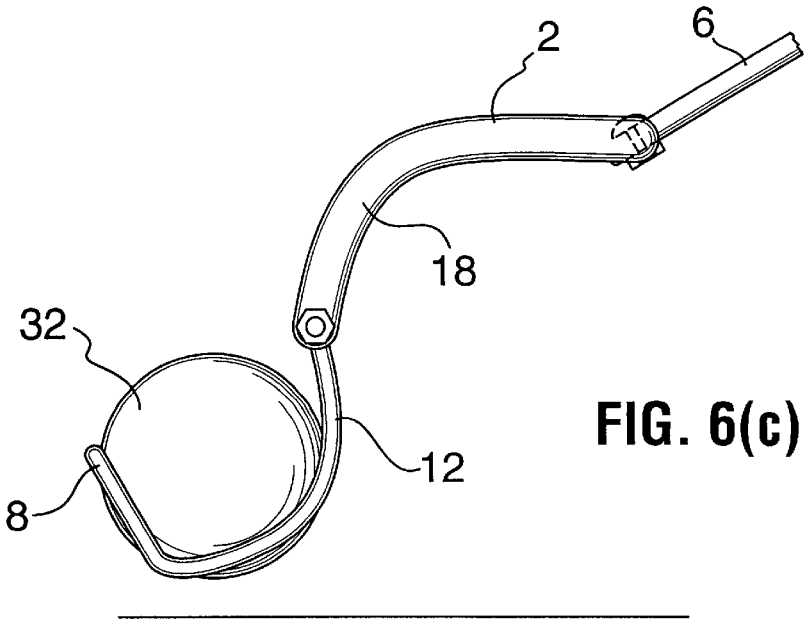
Figure 7A:
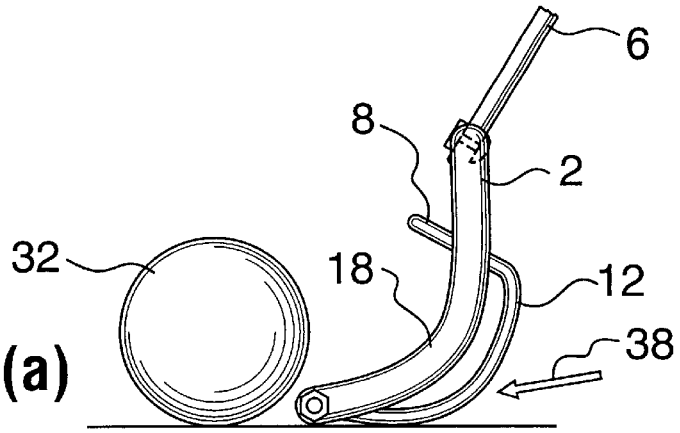
FIGS. 7(*a*), 7(*b*) and 7(*c*) illustrate the sequence of retrieving a golf ball with a scooping motion using the golf ball retriever of FIG. 1.
Figure 7B:
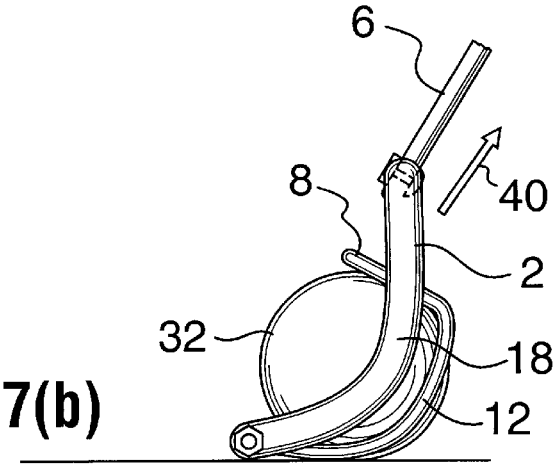
Figure 7C:
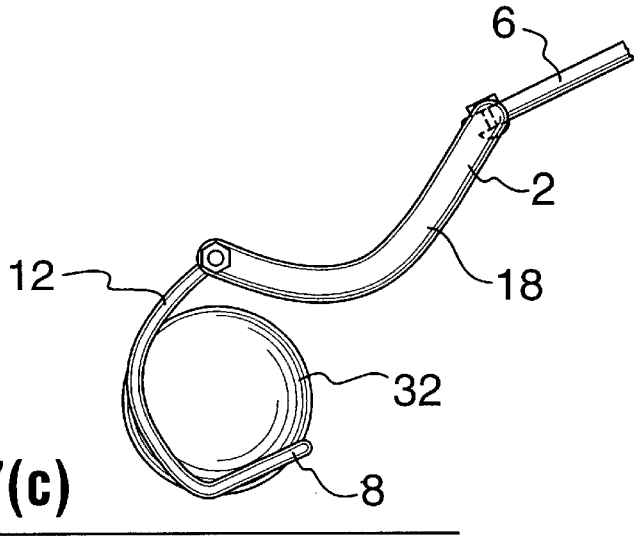

FIGS. 6(*a*)–6(*c*) illustrates the sequence of retrieving a golf ball 32 using retriever 10 with a raking motion, while FIGS. 7(*a*)–7(*c*) illustrate the sequence of retrieving ball 32 using a scooping motion.

Figure 3:
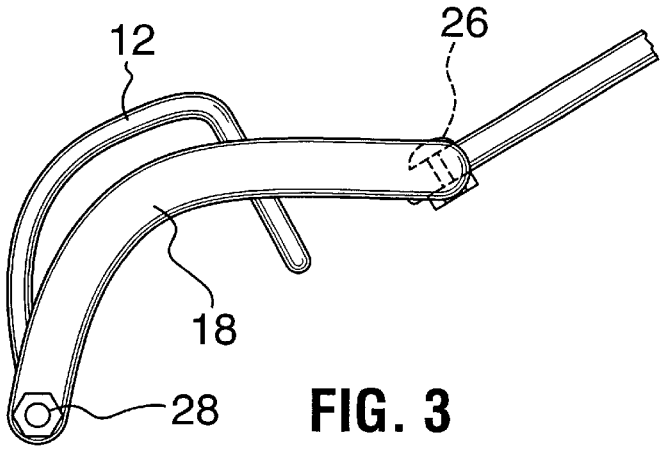
FIG. 3 is a side perspective view of the golf ball retriever of FIG. 1.
Figure 4:
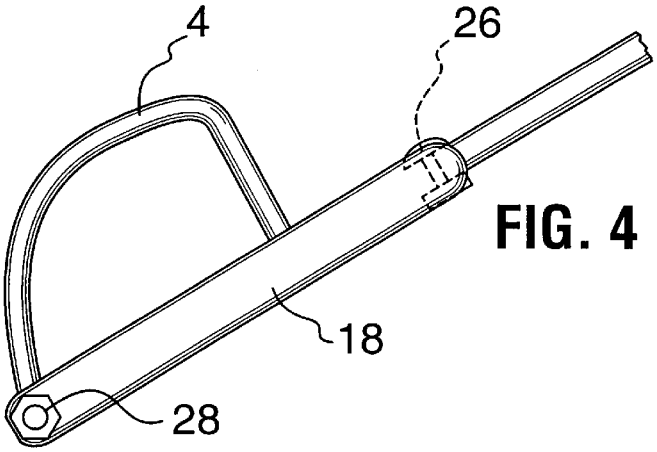
FIG. 4 is a side perspective view of an alternative embodiment of the U-shaped member of the golf ball retriever of FIG. 1.

Turning to FIG. 6(*a*), retriever 10 has been positioned to retrieve ball 32 with a raking motion. Specifically, U-shaped member 2 is pushed down over ball 32 so that arms 18, 20 straddle ball 32. This causes ball 32 to pass into the mouth formed by arms 18, 20 and into contact with cradle 4. Retriever 10 is then pulled towards the user in the direction of arrow 34 in FIG. 6(*a*). Doing this results in the position of retriever 10 as shown in FIG. 6(*b*). Specifically, pulling retriever 10 in the direction of arrow 34 causes cradle 4 to pivot in a counterclock-wise direction relative to U-shaped member 2 until ball 32 comes into contact with cradle catch member 8. This is due to the shape of cradle arms 12 and 14. FIG. 3 illustrates that cradle arms 12 and 14 are curved in a manner similar to arm 18 of U-shaped member (cradle arm 14 is not shown in FIG. 3, but is curved identically to cradle arm 12). This curvature allows arms 12 and 14 to slide gently underneath ball 32 along the underlying surface as one moves retriever 10 from the position of FIG. 6(*b*) to that of FIG. 6(*c*). Next, the user pulls retriever 10 in the direction of arrow 36 in FIG. 6(*b*). The upward lifting results, first, in arms 18 and 20 of U-shaped member 2 being pulled increasingly away from the underlying surface, and second, cradle 4 further pivoting about U-shaped member 2 under the weight of ball 32. The shape of cradle arms 12 and 14 facilitate this transition. In addition to the curvature of cradle arms 12 and 14 mentioned above, cradle arms 12 and 14 also curve inwardly towards one another between their respective first and second ends so that the distance therebetween is less than the diameter of golf ball 32 (see FIGS. 1 and 2). That is, cradle arms 12 and 14 flare or widen as they approach their respective second (12(*b*) and 14(*b*)) ends. This widening or flaring causes ball 32 to be guided along cradle arms 12 and 14 towards cradle catch member 8. Cradle catch member 8 is also curved (see FIG. 2) to receive the curvature of ball 32. After ball 32 is lifted off the underlying surface, it thus becomes nestled in cradle 4 and is contacted in three locations, namely, by cradle arm 12, by cradle arm 14 and by cradle catch member 8. The widening or flaring of cradle arms 12 and 14 ensures that ball 32 is continuously guided towards catch member 8 when cradle 4 hangs from U-shaped member 2. The secure engagement of ball 32 in the three locations mentioned above, the pivotal attachment of cradle 4 to U-shaped member 2 and the widening or flared curvature of cradle arms 12 and 14 all prevent ball 32 from being dropped after it has been lifted from an underlying surface, even with abrupt tilting of retriever 10 from a horizontal position to an angled position.

As illustrated in FIG. 1, the distance between second ends 12(*b*) and 14(*b*) of cradle arms 12 and 14 (i.e. the length of cradle catch member 8) is such to prevent cradle 4 from fully pivoting. That is, when cradle 4 is in the position of FIG. 6(*a*), cradle catch member 8 abuts arms 18, 20 of U-shaped member 2 (see FIG. 1). This prevents cradle 4 from pivoting in a further clockwise direction (referring to FIG. 6(*a*)). Otherwise, cradle 4 could fully pivot to a position where ball 32 could not pass through the mouth and onto cradle arms 12, 14 to be guided toward s cradle catch member 8.

Turning to FIG. 7(*a*), retriever 10 has been positioned to retrieve ball 32 with a scooping motion. Specifically, retriever 10 is placed in an upright position on the near side of ball 32 and is pushed away from the user in the direction of arrow 38 in FIG. 7(*a*). This causes the distal ends of arms 18 and 20 to move underneath ball 32, thus scooping ball 32. This motion is facilitated by the curvature in arms 18 and 20 of U-shaped member 2, as well as the similar curvature of cradle arms 12 and 14. Once ball 32 has passed through the mouth formed by arms 18 and 20 and into contact with cradle 4, the retriever can be lifted towards the user in the direction of arrow 40 of FIG. 7(*b*). This lifting causes ball 32 to be guided by flared cradle arms 12 and 14, as described above, towards cradle catch member 8. Ball 32 is securely held by cradle arms 12 and 14 and catch member 8 as cradle 4 pivots about U-shaped member 2.

U-shaped member 2 and cradle 4 are preferably constructed out of stainless steel, although it will be appreciated that other materials such as hard plastic or the like could also be used. Cradle 4, comprising cradle arms 12 and 14 and cradle catch member 8, preferably comprises a single integral wire, as illustrated in FIGS. 1–7(*c*), rather than separate attached pieces. Due to the rigidity and strength of U-shaped member 2, retriever 10 can be used to dig balls which are buried (partial or otherwise) out of mud and ground.

Figure 5:
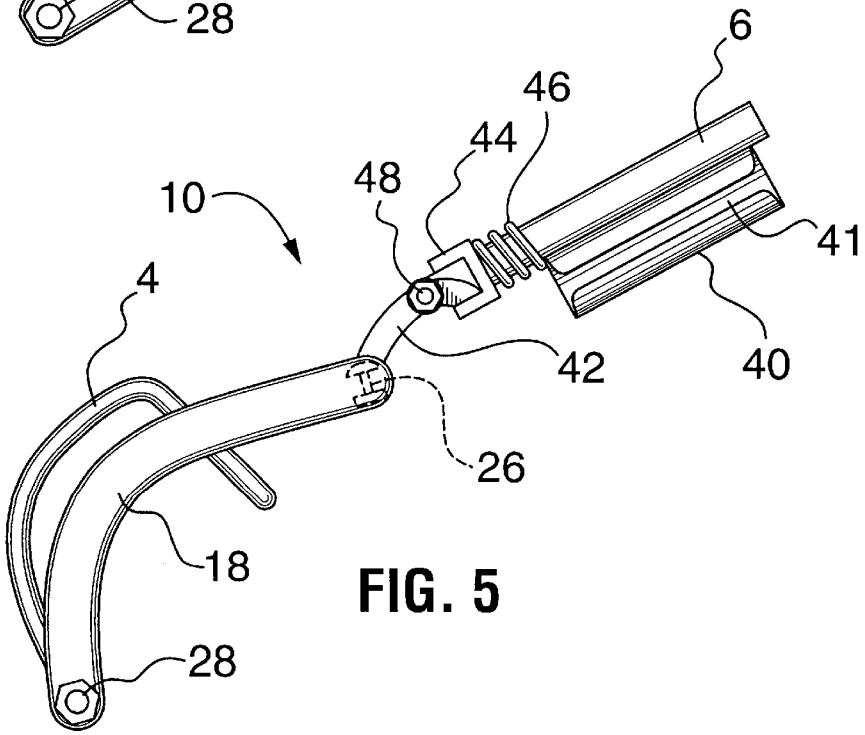
FIG. 5 is a side perspective view of the golf ball retriever of FIG. 1 with a hinging mechanism and an attachment mechanism.

FIG. 5 illustrates that shaft 6 may be fitted with tubular sleeve 40 for attaching retriever 10 to an extension to reach distant golf balls. Specifically, tubular sleeve is attached along shaft 6 by suitable attachment means and provides a slit 41 for inserting a telescoping rod, the hosel or shaft of a golf club or any other available extension for assisting a user in retrieving a golf ball out of his or her immediate reach. Tubular sleeve 40 is preferably constructed out of hard PVC plastic for flexibility and strength.

FIG. 5 also illustrates that a mechanism to hinge or fold retriever 10 for storage. Hinging is made possible by bridge 42, bracket 44 and spring 46. Bridge 44 is attached to U-shaped member 2 by nut and bolt assembly 26 and is also attached on an intermediate location to shaft 6 by similar nut and bolt assembly 48. The bolt of nut and bolt assembly 48 is perpendicular to the bolt of nut and bolt assembly 26. Bracket 44 is movable along shaft 6 (bracket 44 has a central bore), but is normally biased against bridge 42 by spring 46 in the position illustrated in FIG. 5. Spring 46 is held in place by tubular sleeve 40. Hinging of shaft 6 is accomplished by pulling bracket 44 along shaft 6 towards tubular sleeve 40 until it no longer engages bridge 42. At this point shaft 6 is free to pivot about nut and bolt assembly 48 in a counterclockwise direction (referring to FIG. 5), thus compacting retriever 10 for easy storage in a side pocket of a golf bag or the like. The ability to detach (from an extension) and store (in a golf bag pocket) retriever 10 is important because many golfers are adverse to the stigma that attaches to one carrying a golf ball retriever. Quite simply, many golfers do not want to be seen carrying a golf ball retriever.

It will be appreciated by those skilled in the art that retriever 10 may also be attached permanently to a suitable extension. In such cases, shaft 6 as illustrated in FIGS. 1–7(*c*) would simply represent the end or tip of that operating extension.

Figure 8:
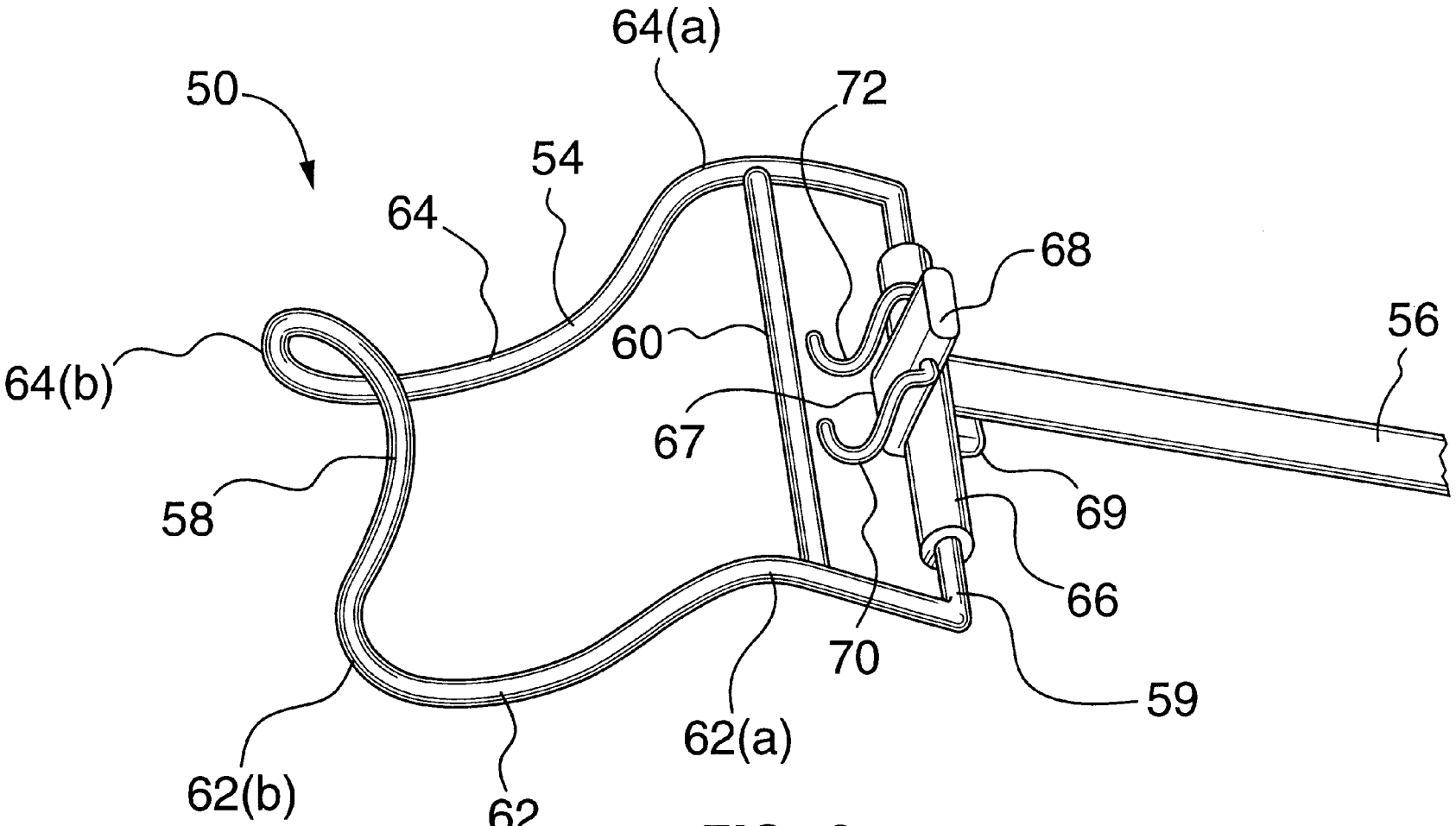
FIG. 8 is a side perspective view of an alternative embodiment of the golf ball retriever.

FIG. 8 illustrates an alternative embodiment to the retriever illustrated in FIGS. 1–7(*c*). Generally, retriever 50 is comprised of shaft 56, cradle 54, first transverse bar 59 and second transverse bar 60. Cradle 54 is comprised of cradle catch member 58, cradle arms 62 and 64, which each have a first end, 62(*a*) and 64(*a*), respectively, and a second end, 62(*b*) and 64(*b*), respectively. In this manner, cradle catch member 58 and the second ends, 62(*b*) and 64(*b*), of cradle arms 62 and 64 are identical to the like elements of retriever 10 described above. However, the first ends 62(*a*) and 64(*a*) of cradle arms 62 and 64 flare or widen dramatically until connecting to second transverse bar 60. This results in a distance between first ends 62(*a*) and 64(*a*) of cradle arms 62 and 64 that is greater than the diameter of a golf ball. This is the mouth of retriever 50. In operation, a user places retriever 50 over the ball so that the ball enters the mouth of retriever 50. At that point, retriever 50 can then be pulled towards the user, causing the ball to be guided down cradle arms 62 and 64 towards cradle catch member 58, as described above. As retriever 50 is lifted upwardly, cradle 54 pivots under the weight of the golf ball.

Cradle 54 hangs pivotally from shaft 56 to encourage the engagement of a golf ball by cradle arms 62 and 64 and cradle catch member 58, as described above in relation to retriever 10. However, cradle 54 does not hang from a U-shaped member, but does so through first transverse bar 59 and tube 66. Upper portion 67 of L-shaped member 68 is attached to shaft 56, while lower portion 69 supports tube 66. Thus, cradle 54 is able to hang and pivot from shaft 56. It will be appreciated that retriever 50 could be modified in many different alternatives to the configuration of tube 66 and L-shaped member 68 to achieve the pivotal attachment of cradle 54 to shaft 56.

L-shaped member 68 also has two pivotal hooks 70 and 72, which can engage second transverse bar 60. This maintains cradle 54 in a fixed, rather than freely pivoting, position to allow the user to easily manouevre retriever 50 over top of the ball to be retrieved, rather than allowing cradle 54 to pivot freely. After the ball has been engaged by retriever 50, the force of retriever 50 hitting the underlying surface causes hooks 70 and 72 to pivot slightly, disengaging second transverse bar 60, allowing cradle 54 to pivot freely once retriever 50 has been lifted off of the underlying surface with the retrieved ball.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A golf ball retriever comprising:

(a) a handle having a forked end with two arms spaced apart at their free ends by a distance greater than the diameter of a golf ball;

(b) a cradle pivotally attached to said free ends of said arms, said cradle having two cradle arms and a cradle catchment member therebetween, said cradle arms being spaced apart from one another at a point proximate to said cradle catchment member by a distance less than the diameter of a golf ball, said cradle arms being curved and having their concave side adjacent said cradle catchment member, said cradle catchment member being curved and cooperating with said cradle arms so that each of said cradle arms and said cradle catchment member engages a golf ball supported in said cradle.

2. The golf ball retriever of claim 1 wherein each of said cradle arms has a first and a second end, said first ends being pivotally attached to said free ends of said handle and said second ends being connected to said cradle catchment member.

3. The golf ball retriever of claim 2 wherein said cradle arms diverge from said point proximate to said cradle catchment member to said second ends of said cradle arms.

4. The golf ball retriever of claim 3 wherein said cradle catchment member abuts said handle to prevent said cradle from fully pivoting.

5. The golf ball retriever of claim 4 wherein said cradle arms and said handle arms are all longer than the diameter of a golf ball.

6. The golf ball retriever of claim 5 wherein said cradle arms and said cradle catchment member comprises a single integral member.

7. The golf ball retriever of claim 6 wherein said single integral member is a stainless steel wire.

8. The golf ball retriever of claim 1 wherein said handle is attachable to an elongated rod or golf club.

9. The golf ball retriever of claim 8 wherein said retriever is attachable to an elongated rod or golf club by a tube attached to said handle.

10. The golf ball retriever of claim 9 wherein said handle hinges to compact said retriever for storage.

11. A golf ball retriever having a forked end with two arms spaced apart at their free ends by a distance greater than the diameter of a golf ball, said golf ball retriever further comprising a cradle pivotally attached to said free ends of said arms, said cradle having two cradle arms and a cradle catchment member therebetween, said cradle arms being spaced apart from one another at a point proximate to said cradle catchment member by a distance less than the diameter of a golf ball, said cradle arms being curved and having their concave side adjacent said cradle catchment member, said cradle catchment member being curved and cooperating with said cradle arms so that each of said cradle arms and said cradle catchment member engages a golf ball supported in said cradle.

12. The golf ball retriever of claim 11 wherein each of said cradle arms has a first and a second end, said first ends being pivotally attached to said free ends of said arms of said forked end of said retriever and said second ends being connected to said cradle catchment member.

13. The golf ball retriever of claim 12 wherein said cradle arms diverge from said point proximate to said cradle catchment member to said second ends of said cradle arms.

14. The golf ball retriever of claim 13 wherein said cradle catchment member abuts said forked end to prevent said cradle from fully pivoting.

15. The golf ball retriever of claim 14 wherein said cradle arms and said arms of said forked end of said retriever are all longer than the diameter of a golf ball.

16. The golf ball retriever of claim 15 wherein said cradle arms and said cradle catchment member comprises a single integral member.

17. The golf ball retriever of claim 16 wherein said single integral member is a stainless steel wire.

* * * * *